US006431313B1

(12) United States Patent
Petzl et al.

(10) Patent No.: US 6,431,313 B1
(45) Date of Patent: Aug. 13, 2002

(54) ROPING SIT HARNESS WITH FORCE DISTRIBUTOR

(75) Inventors: Paul Petzl, Barraux; Jean Marc Hede, Le Touvet, both of (FR)

(73) Assignee: Zedel, Crolles (FR)

( * ) Notice: Subject to any disclaimer, the term of this patent is extended or adjusted under 35 U.S.C. 154(b) by 0 days.

(21) Appl. No.: 09/597,110

(22) Filed: Jun. 20, 2000

(30) Foreign Application Priority Data

Jul. 16, 1999 (FR) ..... 99 09411

(51) Int. Cl.[7] ..... A62B 1/16

(52) U.S. Cl. ..... 182/6; 182/3; 119/857; 244/151 R

(58) Field of Search ..... 182/3, 4, 5, 6, 182/7, 8, 9; 119/857; 244/151 R, 152

(56) References Cited

U.S. PATENT DOCUMENTS

| | | | | | |
|---|---|---|---|---|---|
| 2,252,998 | A | * | 8/1941 | Wachtel | 182/6 |
| 3,159,241 | A | * | 12/1964 | Martin | 182/6 |
| 4,132,055 | A | * | 1/1979 | Bird | 54/23 |
| 4,645,033 | A | * | 2/1987 | Oelschlager | 182/6 |
| 4,999,980 | A | * | 3/1991 | McGowan | 54/23 |
| 5,145,027 | A | | 9/1992 | Petzl et al. | |
| 5,445,114 | A | * | 8/1995 | Walker | 182/6 X |
| 5,615,750 | A | * | 4/1997 | Phillips | 182/6 |
| 6,050,364 | A | * | 4/2000 | Propall et al. | 182/6 |
| 6,189,651 | B1 | * | 2/2001 | Sadeck | 182/6 |
| 6,244,379 | B1 | * | 6/2001 | Larson | 182/6 |
| 6,253,874 | B1 | * | 7/2001 | Casebolt et al. | 182/3 |
| 6,283,248 | B1 | * | 9/2001 | Groover | 182/6 |

FOREIGN PATENT DOCUMENTS

| | | | |
|---|---|---|---|
| DE | 2933771 | * | 3/1981 |
| EP | 0736310 | A | 10/1996 |
| FR | 2649618 | A | 1/1991 |
| FR | 2750609 | A | 1/1998 |

* cited by examiner

*Primary Examiner*—Bruce A. Lev
(74) *Attorney, Agent, or Firm*—Oliff & Berridge, PLC

(57) ABSTRACT

A roping sit harness comprises a securing belt joined to a pair of leg loops by an intermediate part. The pair of leg loops and the intermediate part are manufactured from a synthetic fabric stuffed with a padding foam to form a single semi-rigid part. The front part of each leg loop is attached without discontinuity to the joining strap by a triangular distributor joining part arranged to balance the forces applied to said monoblock part. The harness is suitable for many applications such as climbing, mountaineering, caving, pot-holing and/or working at heights.

6 Claims, 5 Drawing Sheets

ROPING SIT HARNESS WITH FORCE DISTRIBUTOR

BACKGROUND OF THE INVENTION

The invention relates to a roping sit harness comprising a securing belt joined to a pair of leg loops by joining means. A sit harness of this kind is used for the safety of people doing mountaineering, caving, pot-holing, climbing, and working at heights.

STATE OF THE TECHNIQUE

Known roping sit harnesses generally comprise leg loops joined to the attachment point by two distinct joining straps. Attachment of the joining straps made of polymer material to the front part of the leg loops is performed either by a sliding assembly by means of securing loops or directly by stitched seams. The manufacturing time of this type of sit harness is relatively long as it requires several stitching and assembly operations in the plant. The flexibility of the joining straps constitutes another drawback for the user, since these straps tend to get twisted when he passes his legs through the leg loops.

FIG. 1 shows a first type of known sit harness which is equipped with leg loops of circular cross section. Application of a force F to the attachment point generates forces F3, F4 and F1 in the left leg loop and forces F5, F6 and F2 in the right leg loop. The harness is well adjusted on the user's thighs but the angle $\alpha$ between the forces F3, F4, and between the forces F5, F6 is about 160°, which contributes to increasing the forces in the leg loops.

FIG. 2 shows a second type of known sit harness with "pear-shaped" leg loops. For the same force F applied to the attachment point, the forces F'3, F'4; F'5, F'6 in the leg loops are lower than the forces F3, F4 ; F5, F6, as the angle $\alpha'$ is smaller than $\alpha$. The harness is however less well adjusted at the level of the user's thighs, due to the fact that the pear shape imposes a larger circumference of the leg loop than that of the user's thigh.

OBJECT OF THE INVENTION

The object of the invention is to achieve a roping sit harness enabling a permanent shaping to be obtained facilitating assembly in the plant and being easier for the user to put on.

The sit harness according to the invention is characterized in that:

- the pair of leg loops is joined to an intermediate part, the assembly being manufactured from a synthetic fabric stuffed with padding foam to constitute a single semi-rigid part,
- the front part of each leg loop is attached without discontinuity to the intermediate part by an internal joining part with a triangular distributor for balancing the forces applied to said monoblock part.

According to a preferred embodiment, the monoblock part formed by the pair of leg loops and the joining strap is manufactured from a semi-rigid complexing cut flat and then reclosed on itself.

According to one feature of the invention, each leg loop presents a non-adjustable closed loop.

According to an alternative embodiment of the invention, each leg loop can be provided with a loop adjustable by means of an adjustment strap operating in conjunction with at least one self-jamming loop. The self-jamming loop is fixed onto each leg loop near to the triangular force distribution zone.

It is clear that the thickness of the padding foam at the level of the triangular joining part can be equal to or greater than that present in the remaining part of the monoblock part.

BRIEF DESCRIPTION OF THE DRAWINGS

Other advantages and features of this invention will become more clearly apparent from the following description of an embodiment of the invention given as a non-restrictive example only and represented in the accompanying drawings, in which.

DESCRIPTION OF A PREFERRED EMBODIMENT

Figure 1:
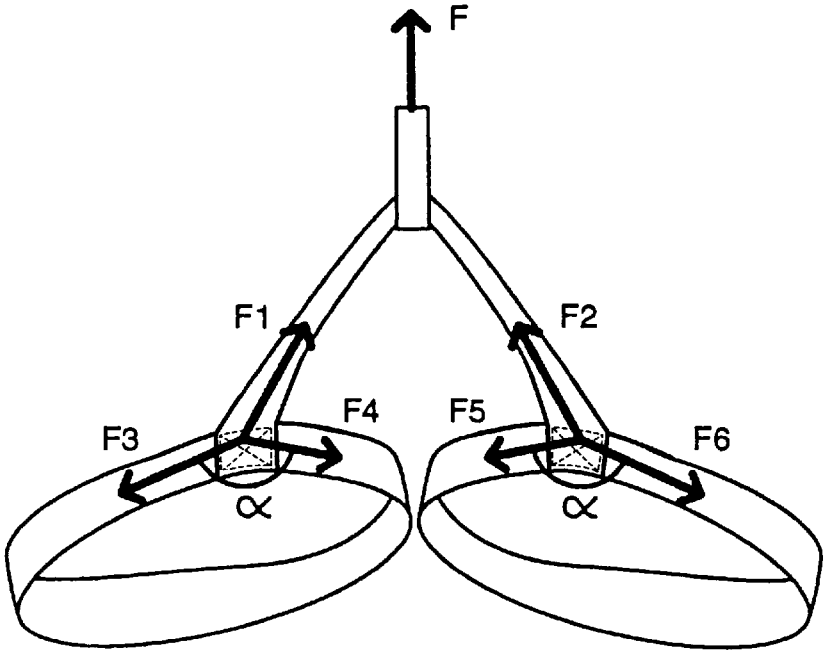
PRIOR ART FIG 1
FIGS. 1 and 2 are schematic views of two sit harnesses of the prior art.
Figure 2:
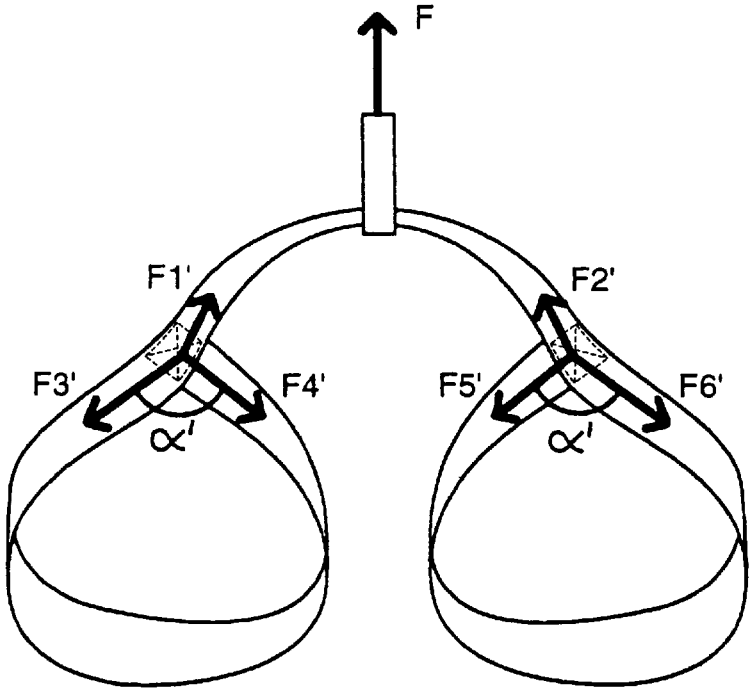
PRIOR ART FIG 2
Figure 3:
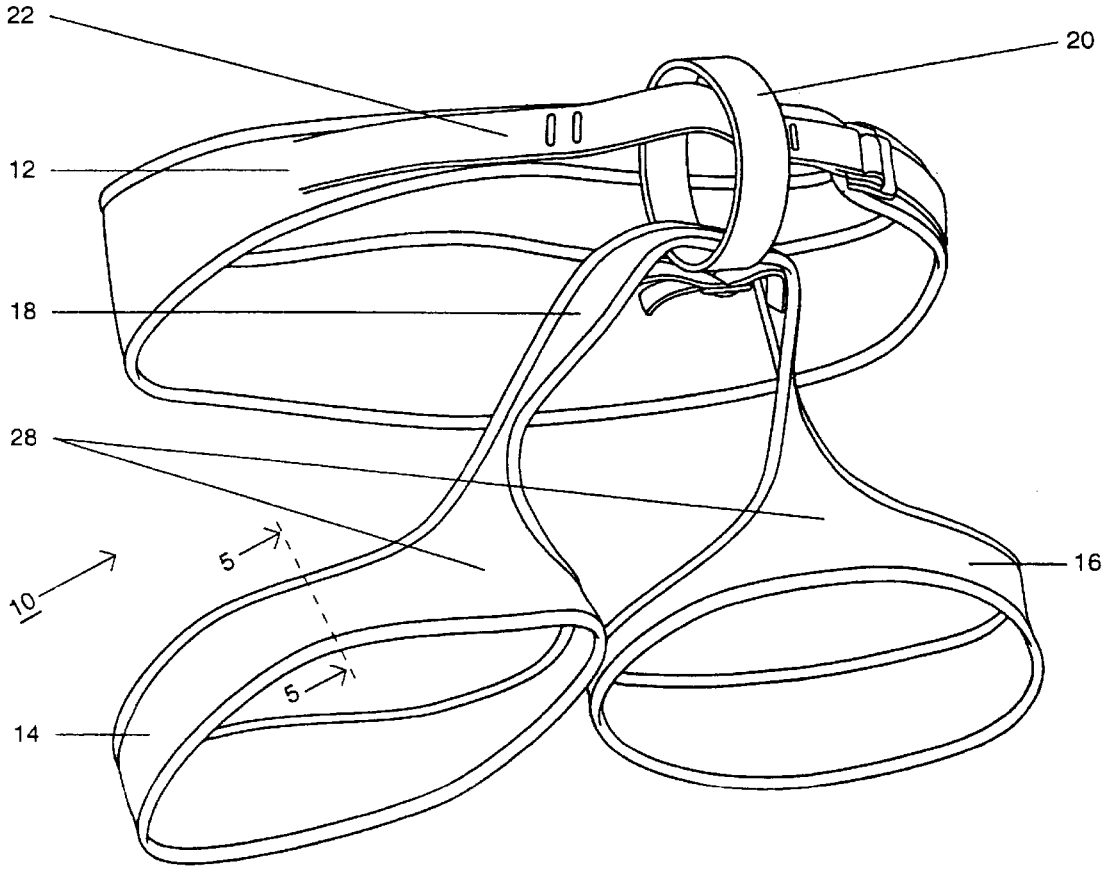
FIG. 3 is a schematic perspective view of a sit harness according to the invention.
Figure 4:
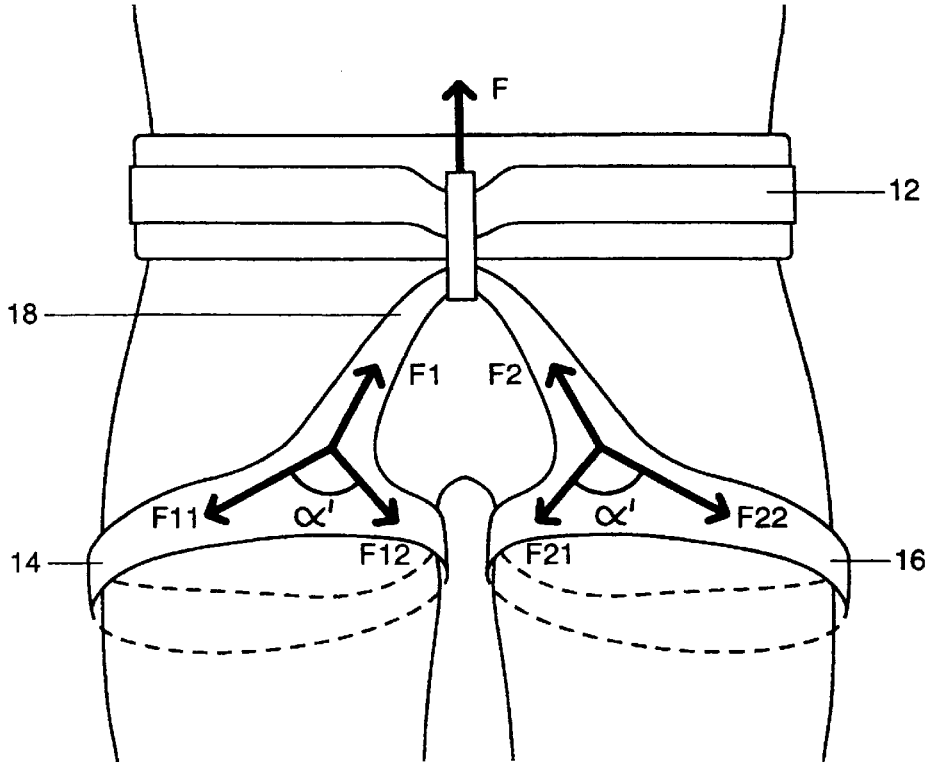
FIG. 4 shows the sit harness of FIG. 3 worn by the user.
Figure 5:
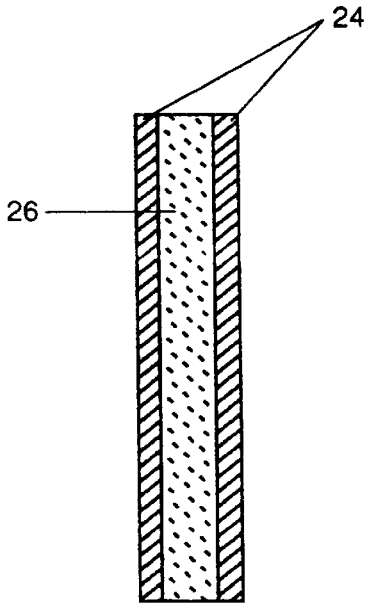
FIG. 5 represents a cross sectional view along the line 5—5 of FIG. 3.

With reference to FIGS. 3 to 5, a roping sit harness 10 comprises a belt 12 attached to a pair of leg loops 14, 16 by a continuous intermediate part 18.

Each leg loop 14, 16 presents a non-adjustable closed loop, and the intermediate joining part 18 is in the shape of an inverted U passing through a securing ring 20 which also passes round the front closing part 22 of the belt 12.

The pair of leg loops 14, 16 and the intermediate part 18 are manufactured by complexing from a synthetic fabric 24, for example polyester, filled with an intercalated padding foam 26. The assembly closed on itself by a binding forms a single monoblock part which does not comprise any stitching or loops in the joining zone with the intermediate part 18. The two fabrics 24 of the complexing can be of different nature, the inner fabric providing user comfort and the outer fabric being more resistant.

The front part of each leg loop 14, 16 is joined to the intermediate part 18 by an internal joining part with triangular distributor 28 arranged to limit the forces F11, F12; F21, F22 applied in each leg loop 14, 16.

The compressible material of the padding foam 26 is particularly favourable for obtaining the balancing effect and results in an optimum level of comfort for the user. The thickness of the padding foam 26 is appreciably constant along the leg loops 14,16 and the joining strap 18.

The monoblock part moreover presents a good resistance for engagement of the leg loops 14, 16, and a high mechanical resistance due to a good distribution of the forces.

The sit harness 10 according to the invention combines the advantages of known sit harnesses (the angle $\alpha'$ is small, well adjusted outline of the leg loops), but without the shortcomings thereof.

Figure 6:
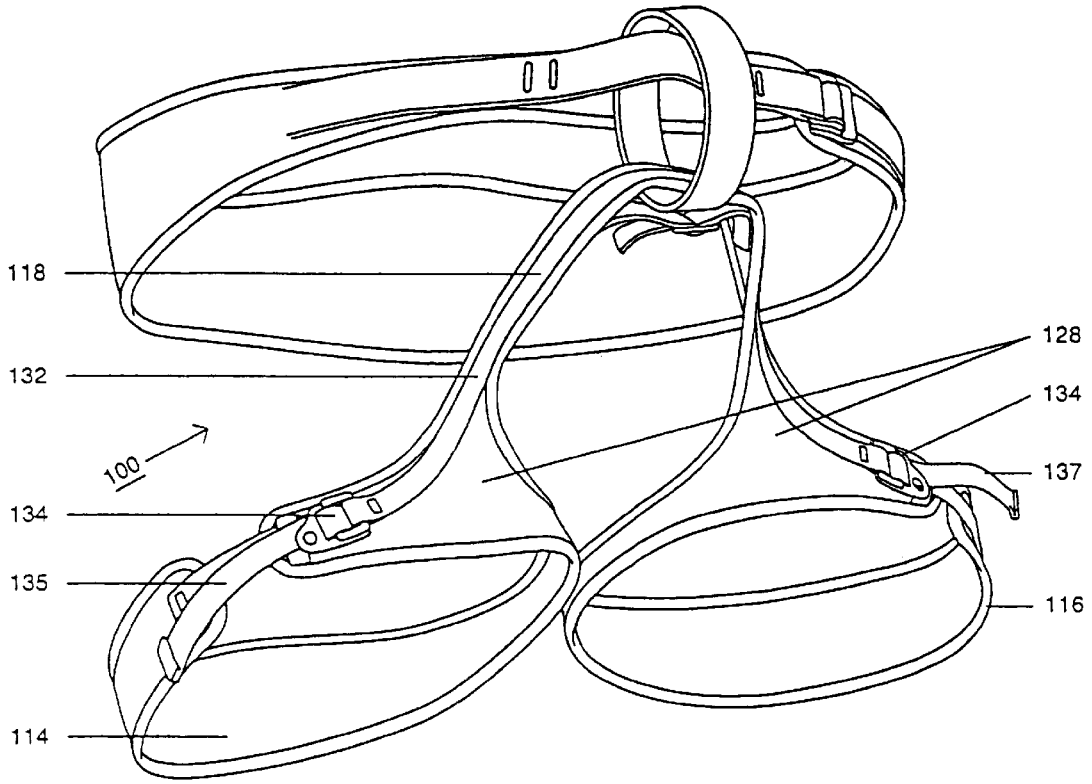
FIG. 6 is an identical view to FIG. 3 of an alternative embodiment of a sit harness with adjustable leg loops.
Figure 7:
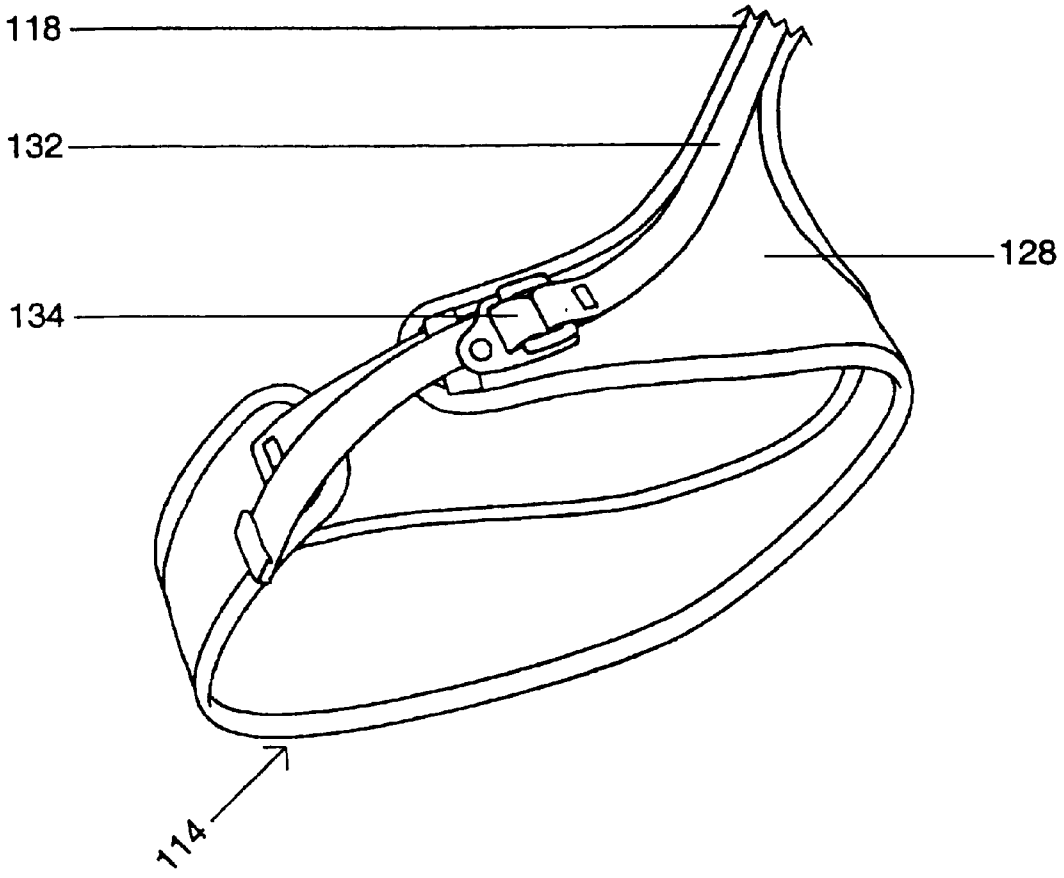
FIG. 7 shows a detailed view of a leg loop of the sit harness according to FIG. 6.

The roping sit harness 100 according to FIGS. 6 and 7 is similar to the one described previously, but is equipped with adjustable leg loops 114, 116.

The adjustment device is formed by a common strap 132 superposed on the joining strap 118 and equipped at each end with a self-jamming loop 134 fixed onto each leg loop 114, 116. Each self-jamming loop 134 is arranged near to the distributor 128 and operates in conjunction with an adjustment strap 135, 137 to adjust the diameter.

What is claimed is:

1. A roping sit harness comprising a securing belt attached to a pair of leg loops by an intermediate part, wherein:

said pair of leg loops and said intermediate part are manufactured from a synthetic fabric stuffed with padding foam of compressible material to constitute a single monoblock semi-rigid part, each leg loop having a front part which is attached without discontinuity and without stitching to the intermediate part by an internal joining part with a triangular distributor for balancing the forces applied to said monoblock part.

2. The roping sit harness according to claim 1, wherein each leg loop presents a non-adjustable closed loop.

3. The roping sit harness according to claim 1, wherein each leg loop presents a loop adjustable by means of an adjustment strap operating in conjunction with at least one self-jamming loop.

4. The roping sit harness according to claim 3, wherein a common strap supports said self-jamming loop on each leg loop, and is superposed on the intermediate part.

5. The roping sit harness according to claim 4, wherein said self-jamming loop is fixed onto each leg loop near the integrated force distributor joining part.

6. The roping sit harness according to claim 1, wherein an angle ($\alpha'$) in the triangular distributor is less than 160° so as to limit the forces applied in each leg loop.

* * * * *